US006166362A

United States Patent [19]

Shon et al.

[11] Patent Number: 6,166,362

[45] Date of Patent: Dec. 26, 2000

[54] AUTOMATIC COOKING CONTROL METHOD FOR A MICROWAVE OVEN

[75] Inventors: Jong-chull Shon, Suwon; Won-woo Lee, Ansan; Tae-soo Park, Suwon; Joon-young Jeong, Seoul; Bo-in Jang; Dong-bin Lim, both of Suwon, all of Rep. of Korea

[73] Assignee: SamSung Electronics Co., Ltd., Suwon, Rep. of Korea

[21] Appl. No.: 09/480,674

[22] Filed: Jan. 11, 2000

[30] Foreign Application Priority Data

| | | | |
|---|---|---|---|
| Jan. 14, 1999 | [KR] | Rep. of Korea | P99-762 |
| Jul. 7, 1999 | [KR] | Rep. of Korea | P99-27330 |
| Jul. 7, 1999 | [KR] | Rep. of Korea | P99-27332 |

[51] Int. Cl.[7] ..... H05B 6/68

[52] U.S. Cl. ..... 219/702; 219/703; 219/754; 219/704; 99/325

[58] Field of Search ..... 219/702, 703, 219/704, 705, 709, 707, 716, 754; 99/325

[56] References Cited

U.S. PATENT DOCUMENTS

| | | | |
|---|---|---|---|
| 4,488,026 | 12/1984 | Tanabe | 219/704 |
| 4,864,088 | 9/1989 | Hiejima et al. | 219/704 |
| 5,550,355 | 8/1996 | Jung | 219/709 |
| 5,773,800 | 6/1998 | Choy | 219/707 |

FOREIGN PATENT DOCUMENTS

| | | | |
|---|---|---|---|
| 59-176655 | 10/1984 | Japan | 219/709 |
| 4-64819 | 2/1992 | Japan | 219/709 |

*Primary Examiner*—Philip H. Leung
*Attorney, Agent, or Firm*—Robert E. Bushnell, Esq.

[57] ABSTRACT

An automatic cooking control method for a microwave oven using data pattern of food, including the steps of: (a) collecting data outputted from a data detecting section for a predetermined time; (b) comparing the collected data with at least one prestored data pattern; and (c) selecting the data pattern among the prestored data pattern that is most similar with the collected data, and performing a cooking operation corresponding to the selected data pattern. When the data collected for the predetermined time corresponds to a no-load pattern, the microwave oven stops the cooking operation. Without separate external data input about weight or physical status of the food in the cooking chamber, the microwave oven automatically selects the most proper cooking process for the food in the cooking chamber by comparing the data about the food in the cooking chamber with the data patterns of the various foods prestored in the microwave oven. Accordingly, the microwave oven becomes easy to operate, and the cooking quality of the microwave oven is improved. Further, by regularly repeating the data collecting, data pattern comparing, and data pattern selecting processes, the microcomputer can perform the proper cooking operation while adjusting the cooking operation in accordance with the respectively selected cooking operations. Thanks to the regular repetition of the above processes, the microwave oven can perform the most proper cooking operation in accordance with the present status of the food in the cooking chamber.

15 Claims, 6 Drawing Sheets

AUTOMATIC COOKING CONTROL METHOD FOR A MICROWAVE OVEN

CLAIM OF PRIORITY

This application makes reference to, incorporates the same herein, and claims all benefits accruing under 35 U.S.C. §119 from our applications, A MICROWAVE OVEN WITH A DEVICE FOR DETECTING MAGNETIC FIELD OF STANDING WAVE AND ITS METHOD filed with the Korean Industrial Property Office on Jan. 14, 1999 and there duly assigned Ser. No. 1999-762, CONTROL METHOD OF A MICROWAVE OVEN WITH A DEVICE FOR DETECTING MAGNETIC FIELD OF STANDING WAVE filed with the Korean Industrial Property Office on Jul. 7, 1999 and there duly assigned Ser. No. 1999-27330, and UNLOAD DECISION METHOD OF A MICROWAVE OVEN WITH A DEVICE FOR DETECTING MAGNETIC FIELD OF STANDING WAVE filed with the Korean Industrial Property Office on Jul. 7, 1999 and there duly assigned Ser. No. 1999-27332.

BACKGROUND OF THE INVENTION

1. Field of the Invention

The present invention relates to a microwave oven, and more particularly to an automatic cooking control method for a microwave oven using a data pattern for food in the microwave oven.

2. Description of the Prior Art

Generally, a microwave oven cooks food by using microwaves, while the intensity of microwaves is varied in accordance with characteristics of the food to be cooked.

That is, various characteristics of the food in a cooking chamber of the microwave oven such as substance, shape, etc., determines the level of the microwave energy and microwave energy absorption, and the microwave oven performs the cooking operation after analyzing the cooking data about the food which are inputted from a user.

FIG. 1 is a partial cutaway view of a conventional microwave oven. As shown in FIG. 1, the conventional microwave oven includes a body 1 formed of a plurality of panels. In the body 1 of the microwave oven, a cooking chamber 2 for cooking the food, and a device chamber 3 for converting an AC power into high voltage, and thus for generating the microwaves are disposed.

The cooking chamber 2 is opened/closed by a door 4, and includes a rotatable tray 5 arranged at a center portion of the cooking chamber 2, onto which the food to be cooked is placed.

Further, in the device chamber 3, various electronic components such as a magnetron MGT for generating the microwaves to be radiated onto the food in the cooking chamber 2, a high voltage transformer HVT, and a high voltage capacitor HVC, etc., are installed. Further, there are provided an air guide 8 for guiding heated air near the magnetron MGT into the cooking chamber 2, and a cooling fan 9 for preventing excessive heat of the electronic components.

On a front side of the device chamber 3, a control panel 7 is formed, having a plurality of function buttons for inputting various cooking conditions and cooking execution commands.

By manipulating the control panel 7, a user inputs various cooking data such as the substance, weight, cooking time of the food on the rotatable tray 5 in the cooking chamber 2 into the microwave oven.

Accordingly, a microcomputer MICOM is employed in the microwave oven to control the general cooking functions of the microwave oven. More specifically, the microcomputer MICOM controls the microwave oven so as to perform the proper cooking function in accordance with the cooking data inputted through the control panel 7.

Meanwhile, when cooking the food on the rotatable tray 5 in the cooking chamber 2 by selecting the corresponding cooking function thereof, the microcomputer MICOM collects the cooking data about the weight or status of the food which are inputted from the user or which are detected by a plurality of sensors in the microwave oven, and performs the proper cooking operation based on the cooking time and cooking method which are prestored in the microwave oven corresponding to the data inputted by the user through the control panel 7 and/or the data collected by the microcomputer MICOM.

As described above, the microwave oven usually memorizes the cooking time and cooking method corresponding to the weight or other data about the cooked foods, and accordingly performs the cooking operation based on the data about the corresponding weight or other corresponding data about the food which are inputted.

For example, when the user selects the cooking function for a popcorn, the user inputs the data as to whether the popcorn is light or weight one. Then, the microcomputer MICOM of the microwave oven performs the proper cooking function in accordance with the weight data inputted through the control panel 7 about the popcorn during the popcorn cooking operation. In addition to the cooking function, there is a defrosting function in which the user selects the defrosting function, and inputs the data as to the substance of the food to defrost, i.e., whether the food to defrost is fish or meat or other substances, and the microwave oven accordingly performs the defrosting operation.

As described above, in the conventional microwave oven, since the user has to input the data about weight or substances of the food every time he/she cooks the food, the user has inconvenience when using the microwave oven. Further, when the user inputs incorrect data about the food, the mal-function occurs, and the precise cooking can not be achieved.

The conventional microwave oven also has an automatic cooking function for automatically cooking the food according to its self-detected data about the weight or the temperature of the food which are detected through a weight sensor or a temperature sensor, for cooking, or defrosting the food.

When employing the sensors, however, the exact data of the food can not be obtained. The weight sensor, for example, detects the total weight of the receptacle holding the food and the food, so that the actual weight of the food itself can not be obtained, and the precise cooking operation can not be achieved. Also, the temperature sensor detects local temperature change of the food, again resulting in improper cooking operation of the microwave oven.

According to the conventional microwave oven, since the microwave oven automatically selects the cooking function by its self-detected weight or status of the food based on the data inputted from the user or detected by the sensor, there is a high possibility of having error in the inputted data, and an improper cooking operation.

Further, since the microwave oven performs the cooking operation simply based on the inputted data as to the weight of other data of the food without considering the actual status of the food, such as dry or wet food, the food exposed to the atmosphere and loses freshness, etc, the proper cooking of the food can not be expected.

SUMMARY OF THE INVENTION

The present invention has been developed to overcome the above-mentioned shortcomings of the prior art, and accordingly, it is an object of the present invention to provide an automatic cooking control method for a microwave oven for simplifying the manipulation of the microwave oven, and thus for performing most proper cooking operation by automatically selecting and performing a proper cooking operation for the food to be cooked, without an external input of the data about the food.

The above object is accomplished by an automatic cooking control method for a microwave oven according to the present invention, including the steps of: (a) collecting data outputted from a data detecting section for a predetermined time; (b) comparing the collected data with at least one prestored data pattern; and (c) selecting the data pattern among the prestored data pattern that is most similar with the collected data, and performing a cooking operation corresponding to the selected data pattern.

The data detecting section includes an antenna sensor for detecting microwaves, and the data collected from the data detecting section are comprised of voltage of the microwaves reflected from food based on the voltage of the microwaves radiated into a cooking chamber of the microwave oven.

The collected data may be compared with all the data patterns prestored in the microwave oven. Also, the collected data may be compared with the selected data patterns from the prestored data patterns which are performed on the same cooking function as the cooking function corresponding to the collected data.

The at least one data pattern includes a data pattern corresponding to a no-load of the microwave oven, and the microwave oven stops the cooking operation when the data collected for the predetermined time period corresponds with the no-load of the microwave oven.

With the automatic cooking control method for the microwave oven according to the preferred embodiment of the present invention, the data outputted for a predetermined time period are collected from the data detecting section, and the most similar data pattern with the collected pattern is selected among the memory section after comparing the collected data patter with the data patter prestored in the memory section, and the cooking operation is performed according to the selected data pattern. Accordingly, without separate input of the data about the weight or physical status of the food in the cooking chamber, the food in the cooking chamber can be properly cooked by comparing the collected data pattern of the food with the data patterns of the various food prestored in the microwave oven.

Further, the above object is accomplished by an automatic cooking control method for a microwave oven according to the present invention, including the steps of: (a) collecting data outputted from a data detecting section during a certain number of rotations; (b) comparing the collected data with a data pattern prestored in the microwave oven on the basis of same rotation counts; (c) selecting the data pattern among the prestored data pattern that is most similar with the collected data on the basis of the same rotation counts, and performing a cooking operation corresponding to the selected data pattern; and (d) repeating the steps of (a), (b), and (c) until a completion of the cooking operation.

With the automatic cooking control method for the microwave oven according to the preferred embodiment of the present invention, the data outputted for a predetermined time period are collected from the data detecting section, and the most similar data pattern with the collected pattern is selected among the memory section after comparing the collected data pattern with the data pattern prestored in the memory section, and the cooking operation is performed according to the selected data pattern. By repeating the above processes, the microwave oven can cook the food in the cooking chamber properly in accordance with the present food status.

Accordingly, without separate external input of the data about the food in the cooking chamber, the microwave oven can cook the food in the cooking chamber properly by automatically selecting and performing the proper cooking process corresponding to the present food status in the cooking chamber. As a result, the microwave oven becomes easy to operate, and has an improved cooking quality.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, a microwave oven according to a first preferred embodiment of the present invention will be described in greater detail with reference to the accompanied drawings. In the description, the construction of a microwave oven according to the preferred embodiments of the present invention will be firstly described with reference to FIGS. 2 and 3, and the automatic cooking control methods according to the preferred embodiments of the present invention will be described secondly with reference to the flow charts of FIGS. 4 and 5.

Figure 2:
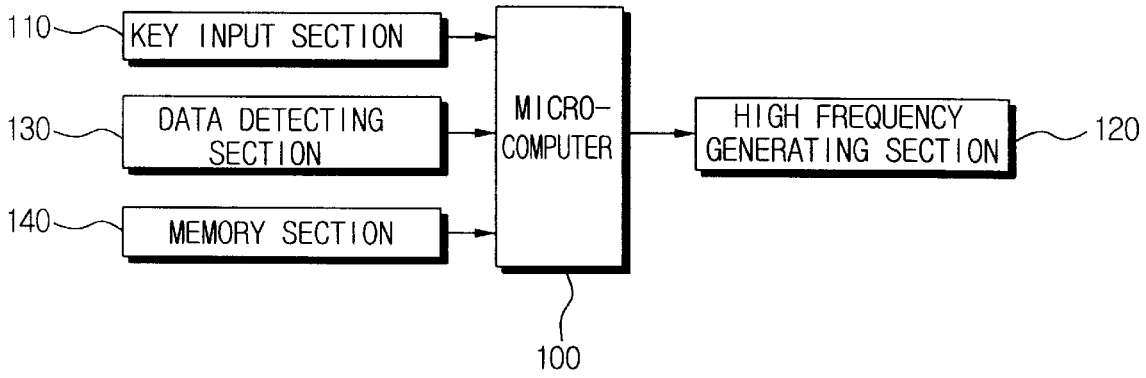
FIG. 2 is a block diagram for showing the structure of a microwave oven employing an automatic cooking control method according to the present invention.
Figure 3:
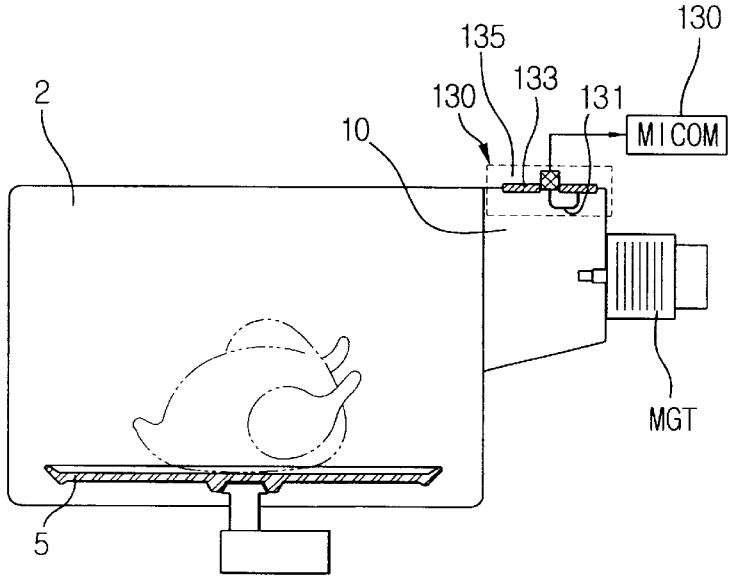
FIG. 3 is a sectional view for showing inner portion of the microwave oven employing the automatic cooking control method according to the present invention.

FIG. 2 is a block diagram for showing the structure of a microwave oven employing an automatic cooking control method according to the present invention, and FIG. 3 is a sectional view for showing inner portion of the microwave oven employing the automatic cooking control method according to the present invention.

The microwave oven includes a key input section 110 for inputting an operational commands from a user, a microcomputer 100 for controlling the various devices of the microwave oven in accordance with the operational commands inputted through the key input section 110, and a high frequency generating section 120 for generating the high frequency microwaves by the high frequency generating control signals from the microcomputer 100. Further, the microwave oven includes a data detecting section 130 for detecting the high frequency generated from the high frequency generating section 120 and for obtaining voltage reflected from the cooking chamber, and a memory section 140 for storing cooking processes corresponding to the data patterns of the voltage reflected from the various foods in the cooking chamber.

As shown in FIG. 3, the data detecting section 130 includes an antenna sensor 131 disposed in a waveguide 10, a shield member 133 for fixing the antenna sensor 131, and a circuit section 135 having a diode connected with the antenna sensor 131 for rectifying the voltage induced at the antenna sensor 131 due to the magnetic field of the stationary wave, and a smoothing capacitor for smoothing the rectified voltage, and a resistor, to obtain the voltage data of the stationary wave reflected from the cooking chamber 2 and is passed through the waveguide 10. The antenna sensor is disclosed in the Korean Patent Publication No. 98-161026 in detail, entitled "High frequency heating apparatus", filed on Jun. 19, 1993 by the same applicant (assignee) of this application, now published on Dec. 15, 1999.

Figure 6A:
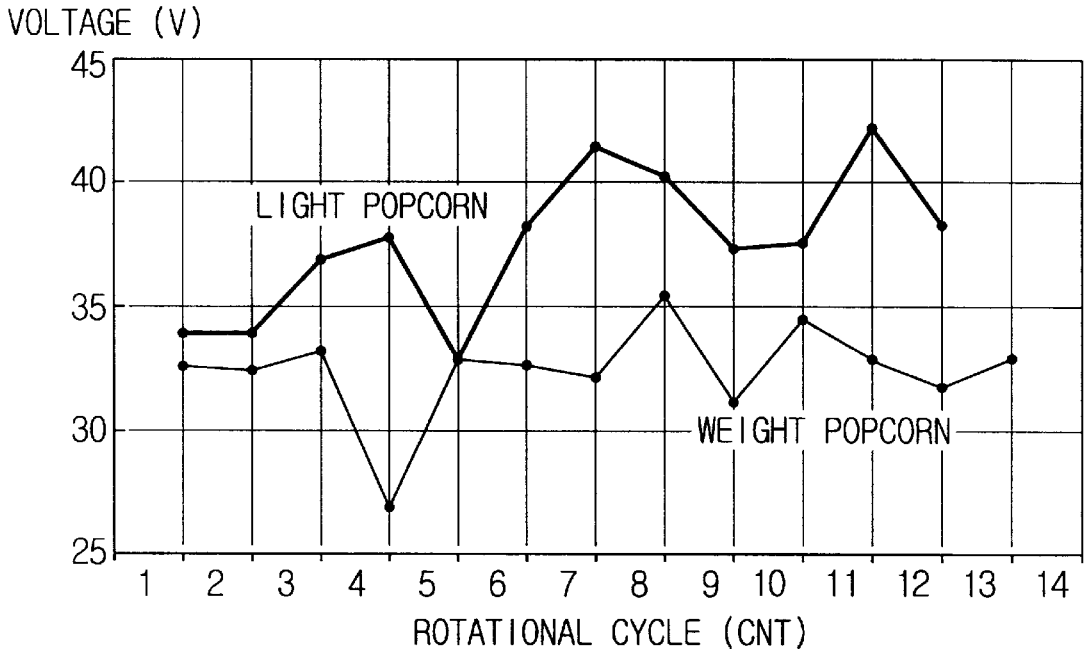
FIGS. 6A to 6D are graphs for showing data patterns for the various foods stored in the microwave oven according to the automatic cooking control method for the microwave oven according to the present invention.
Figure 6B:
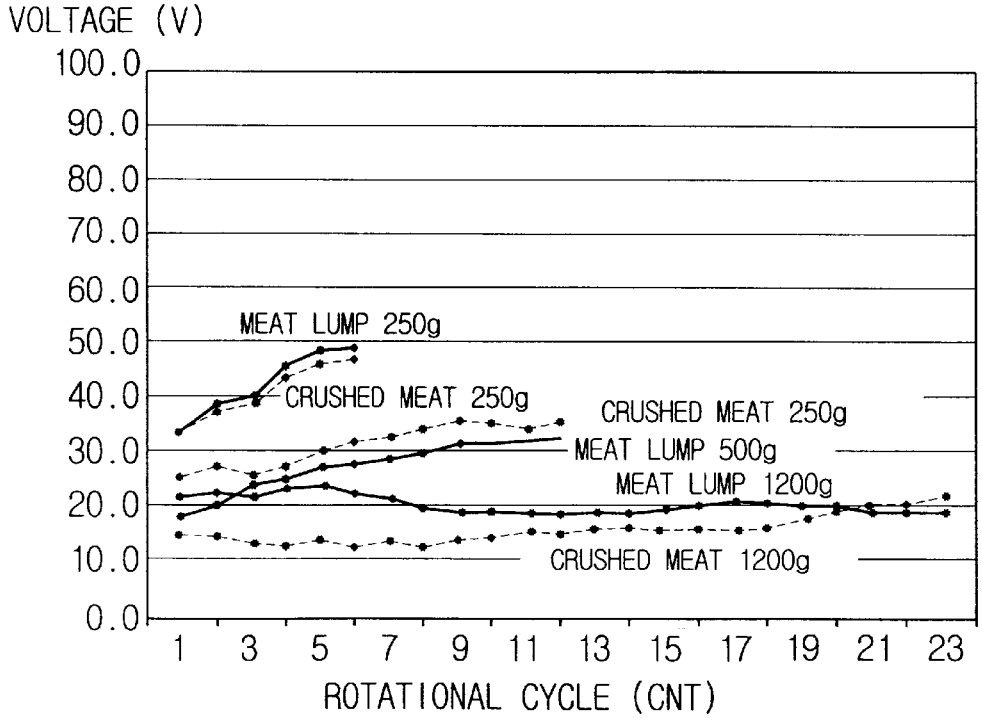
Figure 6C:
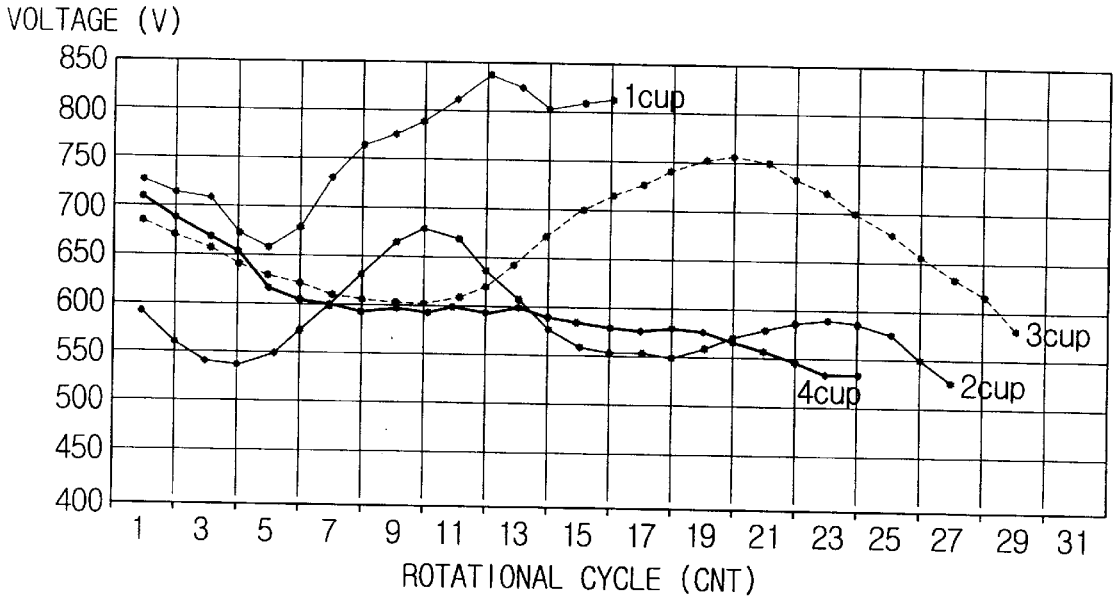
Figure 6D:
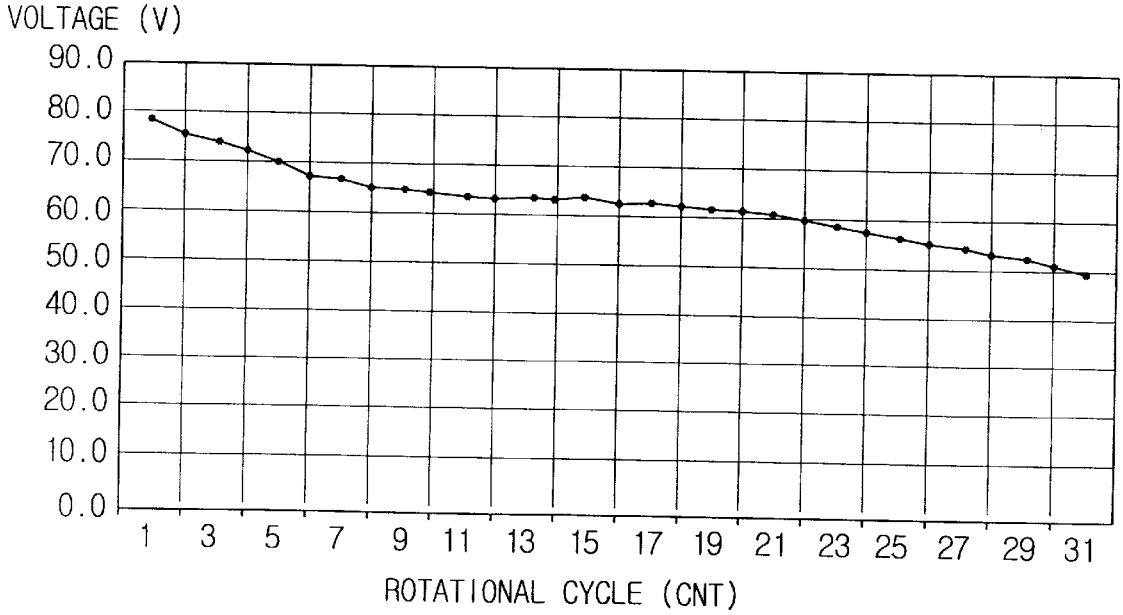

In the memory section 140, the data pattern about the voltage of the stationary wave reflected from the food in the cooking chamber is stored. FIGS. 6A to 6D are graphs for showing data patterns for the various foods stored in the microwave oven according to the automatic cooking control method for the microwave oven according to the present invention, in which the voltage of the reflected wave with respect to the rotation counts is shown. FIG. 6A shows the data pattern detected from the popcorn of two general weights, FIG. 6B shows the data pattern detected from the meat lump and the crushed meat during the defrosting operation, FIG. 6C shows the data pattern detected from the water of respective weights during the warming operation, and FIG. 6D shows the data pattern detected when the microwave oven is in no-load state, i.e., when there is no food in the cooking chamber.

Figure 4:
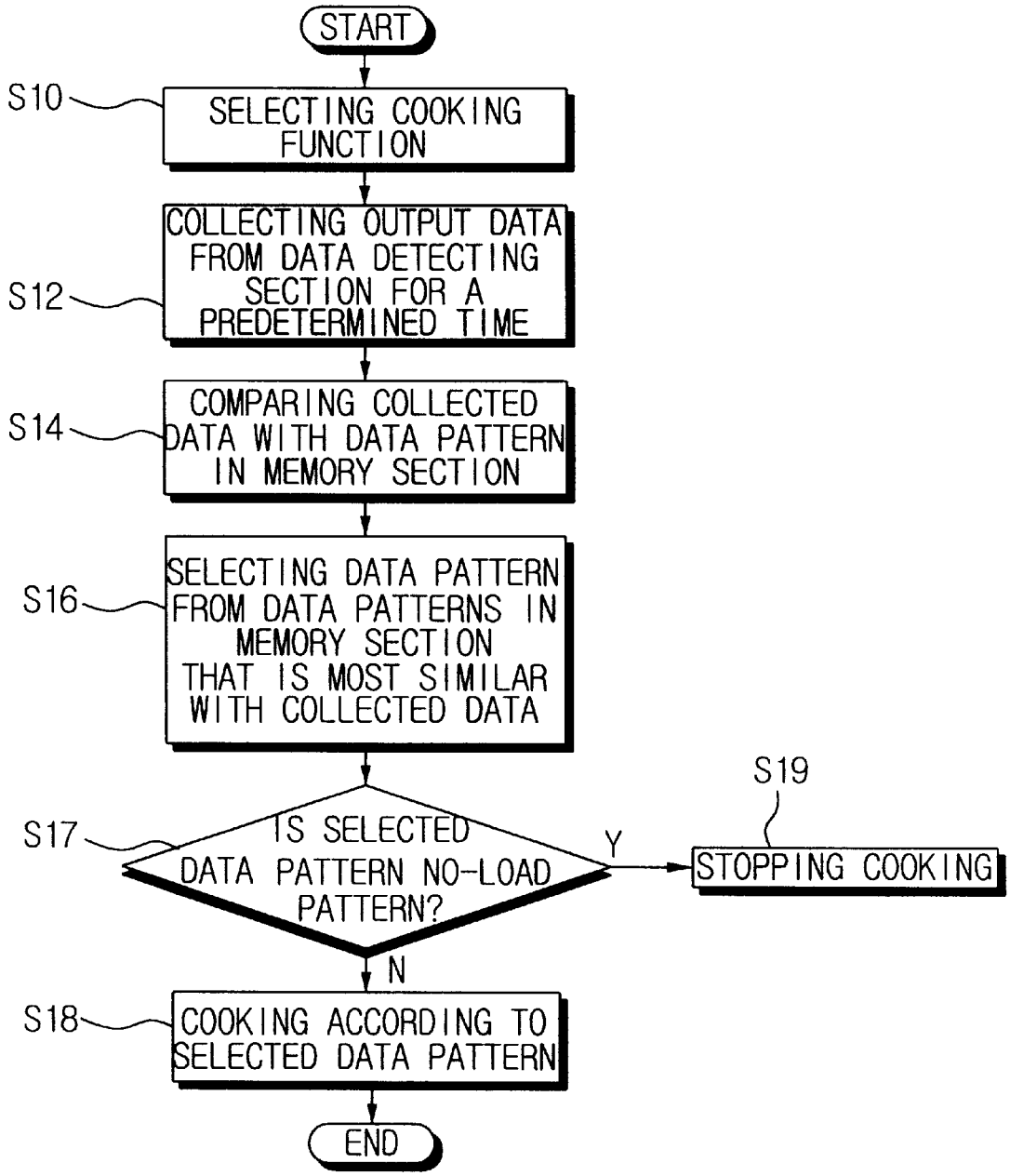
FIG. 4 is a flow chart for explaining the automatic cooking control method for the microwave oven according to the preferred embodiment of the present invention.

The operation of the microwave oven employing the automatic cooking control methods according to the first and second preferred embodiments of the present invention will be described below in greater detail with reference to the flow charts of FIGS. 4 and 5.

Figure 1:
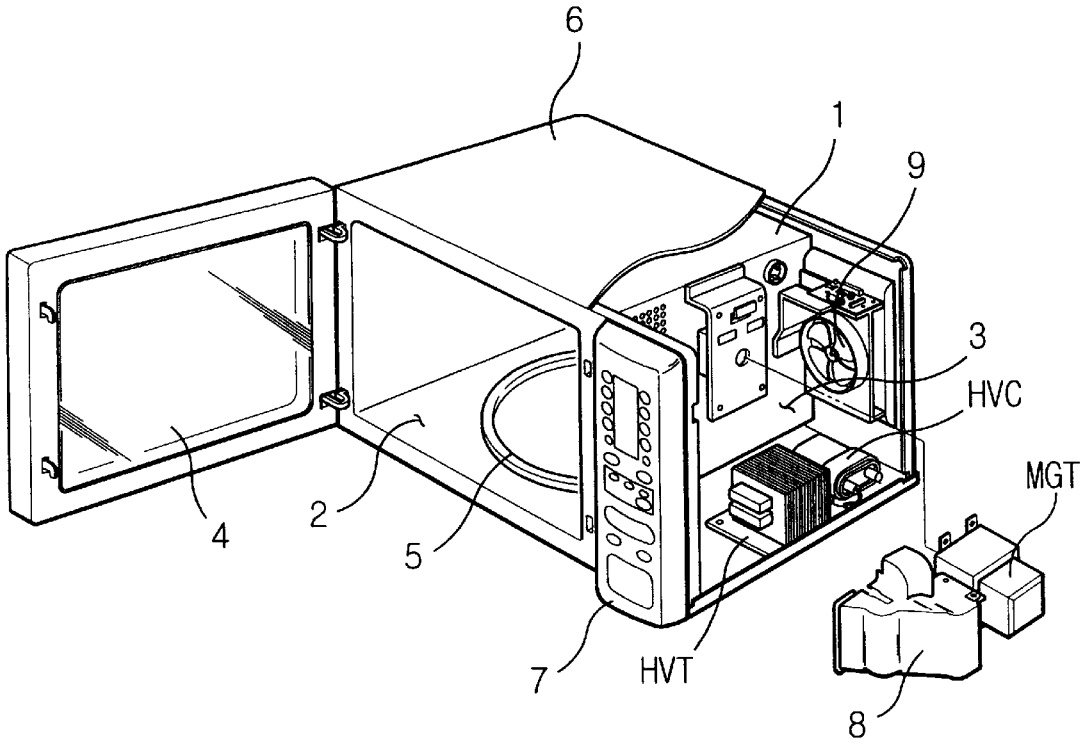
FIG. 1 (PRIOR ART)
FIG. 1 is a partial cutaway perspective view of a conventional microwave oven.

Referring to FIG. 1, a user places the food in the cooking chamber, and selects his/her desired cooking function (step S10). For example, the user selects the popcorn function for the popcorn, defrosting function for frozen meat, or warming function for warming the water.

Then the microwave oven is operated according to the selected function in S10 (step S12). Here, the microcomputer collects the voltage outputted from the data detecting section 130 for a predetermined time period. Here, suppose one rotation of the rotatable tray 5 takes 10 seconds, the microcomputer collects the voltage outputted from the data detecting section 130 for 50 seconds, i.e., during 5 rotations of the rotatable tray 5.

Then the microcomputer compares the data pattern stored in the memory section 140 with the collected data of step S12 (step S14).

Here, the data patterns compared with the collected data may be all the data patterns prestored in the memory section 140, or may be the selected data patterns among the data patterns stored in the memory 140 which are performed on the same function as the selected function of step S10.

In the latter's case, the microcomputer performs the comparing process more precisely, by reading the data patterns performed on the same function as the selected function of step S10 among the data patterns prestored in the memory section 140 from the memory section 140, and comparing the selected data patterns read from the memory section 140 with the collected data of step S12.

The microcomputer selects the most similar data pattern from the data patterns read from the memory section 140 as the collected data (step S16).

Then, the microcomputer checks whether the selected data pattern from the memory section 140 is no-load pattern or not (step S17).

Then the microcomputer performs the cooking operation according to the selected data pattern from the memory section 140, when determining the data pattern is not no-load pattern in step S17 (step S18).

When determining the no-load pattern in step S17, the microcomputer stops the cooking operation (step S19).

As described above, with the automatic cooking control method for the microwave oven according to the preferred embodiment of the present invention, the data outputted for a predetermined time period are collected from the data detecting section, and the most similar data pattern with the collected pattern is selected among the memory section after comparing the collected data pattern with the data pattern prestored in the memory section, and the cooking operation is performed according to the selected data pattern.

Accordingly, without separate input of the data about the weight or physical status of the food in the cooking chamber, the food in the cooking chamber can be properly cooked by comparing the collected data pattern of the food with the data patterns of the various food prestored in the microwave oven.

While the microwave oven according to the first preferred embodiment of the present invention performs the cooking operation according to the selected data pattern after processes of data collecting, and data pattern comparing for once, respectively, the microwave oven according to the second preferred embodiment of the present invention repeats the processes of data collecting, data pattern comparing, and data pattern selecting, while adjusting the cooking operation according to the respectively selected data pattern.

Figure 5:
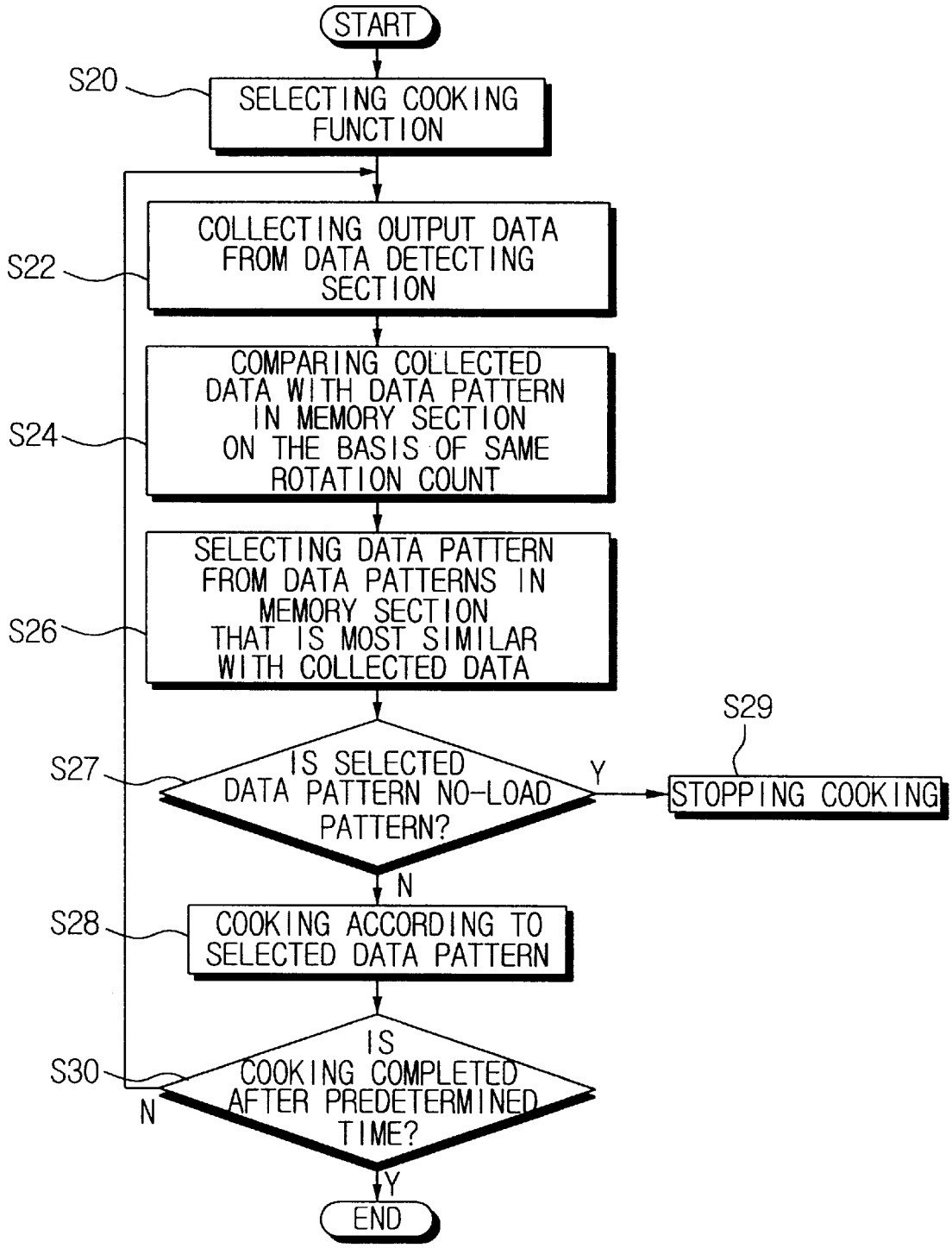
FIG. 5 is a flow chart for explaining the automatic cooking control method for the microwave oven according to another preferred embodiment of the present invention.

Referring to FIG. 5, the user places the food in the cooking chamber, and selects his/her desired cooking function (step S20). For example, the user selects the popcorn function for the popcorn, defrosting function for frozen meat, or warming operation for warming the water.

Then the microwave oven is operated according to the selected function in S20 (step S22). Here, the microcomputer collects the voltage outputted from the data detecting section 130 during a predetermined number of rotations of the rotatable tray 5 such as during 5 rotations of the rotatable tray 5, for example.

Then the microcomputer compares the data pattern stored in the memory section 140 with the collected data of step S22 (step S24).

Here, the data patterns compared with the collected data may be all the data patterns prestored in the memory section 140, or may be the selected data patterns among the data patterns stored in the memory 140 which are performed on the same function as the selected function of step S20.

In the latter's case, the microcomputer performs the comparing process more precisely, by reading the data patterns preformed on the same function as the selected function of step S20 among the data patterns prestored in the memory section 140 from the memory section 140, and comparing the selected data patterns read from the memory section 140 with the collected data of step S22.

The microcomputer selects the most similar data pattern among the data patterns read from the memory section 140 as the collected data (step S26).

Then, the microcomputer checks whether the selected data pattern from the memory section 140 is no-load pattern or not (step S27).

The microcomputer performs the cooking operation according to the selected data pattern from the memory section 140, when determining the data pattern is not no-load pattern in step S27 (step S28).

When determining the no-load pattern in step S27, the microcomputer stops the cooking operation (step S29).

While performing the cooking operation of step S28, the microcomputer detects whether the cooking operation is completed after a predetermined time (after 5 rotations of the rotatable tray 5, for example) (step S30). When the cooking operation is not completed, the microcomputer returns to the step S22.

As described above, with the automatic cooking control method for the microwave oven according to the preferred embodiment of the present invention, the data outputted for a predetermined time period are collected through the data detecting section, and the most similar data pattern with the collected pattern is selected among the data patterns stored in the memory section after comparing the collected data pattern with the data pattern prestored in the memory section, and the cooking operation is performed according to the selected data pattern. By repeating the above processes, the microwave oven can cook the food in the cooking chamber properly in accordance with the present food status.

Accordingly, without separate external input of the data about the food in the cooking chamber, the microwave oven can cook the food in the cooking chamber properly by automatically selecting and performing the proper cooking process for the present food status in the cooking chamber. As a result, the microwave oven becomes easy to operate, and has an improved cooking quality.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An automatic cooking control method for cooking food in a cooking chamber of a microwave oven, said microwave oven having a data detecting section for detecting a voltage induced by a magnetic field of a stationary wave reflected from within the cooking chamber when the microwave oven operates, said microwave oven having a memory in which is stored a plurality of prestored data patterns, said method comprising the steps of:

(a) collecting data outputted from the data detecting section for a predetermined time, whereby collected data is provided;

(b) comparing the collected data with the plurality of prestored data patterns; and (c) selecting a one of the data patterns from the prestored data patterns, said one of the patterns which is selected being a pattern such that it is most similar to the collected data; and (d) performing a cooking operation corresponding to the selected data pattern, without input of data concerning physical characteristics ofthe food being cooked, and without measurement of a food temperature of the food.

2. The method of claim 1, wherein the data detecting section comprises an antenna sensor for detecting microwaves, and the data collected from the data detecting section are comprised of voltage values induced by the microwaves reflected from food based on the voltage values for the microwaves radiated into the cooking chamber of the microwave oven.

3. The method of claim 1, wherein the collected data is compared with all of the data patterns prestored in the microwave oven.

4. The method of claim 1, wherein the plurality of prestored data patterns includes a data pattern corresponding to a no-load condition ofthe microwave oven, and the microwave oven stops the cooking operation therein when the data collected for the predetermined time period corresponds with the pattern for the no-load condition of the microwave oven.

5. The method of claim 1, wherein the collected data is compared with the selected data patterns from the prestored data patterns which are performed on the same cooking function as the cooking function corresponding to the collected data.

6. The method of claim 5, wherein the selected data pattern comprises a data pattern corresponding to a no-load condition of the microwave oven, and the microwave oven stops the cooking operation therein when the data collected for the predetermined time period corresponds with the pattern for the no-load condition of the microwave oven.

7. An automatic cooking control method for cooking food in a microwave oven, said microwave oven having a rotating turntable which rotates at a predetermined rotation rate, said microwave oven having a completion-determination means for determining when a food cooking operation in the microwave oven has been completed, said microwave oven having a data detecting section for detecting a voltage induced by a magnetic field of a stationary wave reflected from within the microwave oven when it operates, said microwave oven having a memory in which is stored a plurality of prestored data patterns, said method comprising the steps of:

(a) collecting data outputted from the data detecting section during a predetermined number of turntable rotations, whereby collected data is provided;

(b) comparing the collected data with the plurality of data patterns prestored in the memory on the basis of same turntable rotation counts;

(c) selecting a one of the data patterns from the prestored data patterns, said one of the patterns which is selected being a pattern that is most similar to the collected data on the basis ofthe same turntable rotation counts; and (d) performing a cooking operation corresponding to the selected data patterns, without input of data concerning physical characteristics ofthe food being cooked, and without measurement of a food temperature of the food; and (e) repeating the steps of (a), (b), (c) and (d) until the completion-determination means has determined that the cooking operation has been completed.

8. The method of claim 7, wherein the collected data is compared with all the data patterns prestored in the microwave oven.

9. The method of claim 7, wherein the plurality of prestored data patterns includes a data pattern corresponding to a no-load condition of the microwave oven, and the completion-determination means of the microwave oven stops the cooking operation when the data collected for the predetermined time period corresponds with the data pattern of the no-load condition of the microwave oven.

10. The method of claim 7, wherein the collected data is compared with the selected data patterns from the prestored data patterns which are performed on the same cooking function as the cooking function corresponding to the collected data.

11. The method of claim 10, wherein the selected data pattern comprises a data pattern corresponding to a no-load condition of the microwave oven, and the microwave oven stops the cooking operation when the data collected for the predetermined time period corresponds with the data pattern of the no-load condition of the microwave oven.

12. In a microwave oven apparatus, comprising:

a cooking cavity for cooking food;

a turntable within the cooking cavity for rotating and supporting food, a magnetron for transmitting microwave energy to food placed into the cooking cavity; and a completion-determination means for determining when to stop a cooking process within the microwave oven;

the improvement comprising:

a completion-determination means for determining when to stop a cooking process within the microwave oven, in accordance with microwave absorption and reflection properties ofthe food being cooked within the cooking cavity, as measured over a predetermined time interval, and without measurement of physical characteristics or temperature of said food.

13. The apparatus of claim 12, wherein said completion-determination means comprises:

a means for measuring an induced voltage induced by a magnetic field of a stationary wave reflected from within the microwave oven when it operates;

a memory in which is stored a plurality of prestored data patterns;

a means for comparing a pattern of collected data, based on measurements of said induced voltage over a predetermined time interval, successively with ones of said plurality of prestored data patterns; and a completion-determination means for determining when to stop the cooking process, based on a correspondence of said pattern of collected data to a selected one of said prestored data patterns.

14. The apparatus of claim 13, wherein:

a prestored data pattern stored in said memory is a pattern corresponding to a no-load condition of the microwave oven; and said completion-determination means comprises a means for stopping the cooking process when the pattern of collected data corresponds to the pattern corresponding to a no-load condition of the microwave oven.

15. The apparatus of claim 13, wherein said completion-determination means selects a prestored data pattern on the basis of it being a pattern that is most similar to said pattern of collected data, whereby a selected pattern is provided, said selected pattern having a cooking process time length, and stops the cooking process after a time interval corresponding to the cooking process time length.

* * * * *